US009480288B2

(12) United States Patent
Shashy

(10) Patent No.: US 9,480,288 B2
(45) **Date of Patent: *Nov. 1, 2016**

(54) REVERSIBLE COMPRESSION SUPPORT BRA

(71) Applicant: Mary Helen Shashy, Lexington, KY (US)

(72) Inventor: Mary Helen Shashy, Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/305,305

(22) Filed: Jun. 16, 2014

(65) Prior Publication Data

US 2014/0295734 A1 Oct. 2, 2014

Related U.S. Application Data

(63) Continuation-in-part of application No. 13/089,691, filed on Apr. 19, 2011, now Pat. No. 8,777,693, which is a continuation-in-part of application No. 12/773,610, filed on May 4, 2010, now Pat. No. 8,465,341.

(51) Int. Cl.
*A41C 3/02* (2006.01)
*A41C 3/00* (2006.01)

(52) U.S. Cl.
CPC ..... *A41C 3/02* (2013.01); *A41C 3/0057* (2013.01)

(58) Field of Classification Search
CPC ..... A41C 3/0014; A41C 3/02; A41C 3/0028
USPC ..... 450/36–39, 54–58, 92, 93, 79, 80, 85, 450/83, 84, 60–67, 70, 74; 602/53, 61, 41, 602/75, 76, 79, 19
See application file for complete search history.

(56) References Cited

U.S. PATENT DOCUMENTS

| | | | | | |
|---|---|---|---|---|---|
| 4,607,640 | A * | 8/1986 | McCusker | 450/1 |
| 4,781,651 | A * | 11/1988 | Ekins | 450/79 |
| 4,816,005 | A * | 3/1989 | Braaten | 450/58 |
| 5,022,881 | A * | 6/1991 | Nagy | 445/7 |
| 5,032,103 | A * | 7/1991 | Larsson | 450/37 |
| 5,863,236 | A * | 1/1999 | Johnson | 450/62 |
| 5,968,003 | A * | 10/1999 | Sisson | 602/75 |
| 6,083,080 | A * | 7/2000 | Lawson et al. | 450/39 |
| 6,110,005 | A * | 8/2000 | Stephenson et al. | 450/39 |
| 6,165,045 | A * | 12/2000 | Miller et al. | 450/1 |
| 6,168,498 | B1 * | 1/2001 | Wagner | 450/58 |
| 6,464,717 | B1 * | 10/2002 | Smith et al. | 607/108 |

(Continued)

FOREIGN PATENT DOCUMENTS

| | | |
|---|---|---|
| EP | 1084632 | 3/2001 |
| FR | 2864429 | 7/2005 |

*Primary Examiner* — Gloria Hale
(74) *Attorney, Agent, or Firm* — Robert R. Strack

(57) ABSTRACT

A reversible bra for compression stabilizing the breast mass against motion relative to the torso includes a zipper side and a non-zipper side with shoulder straps in a pattern to approximately match the contours of a female user's torso whether the zipper is worn in the front or in the back. The zipper in positioned on the zipper side down the center of the zipper side from a seam at the top adjacent the straps to provide a non-stretchable seam which reduces the stretch area at the location of the breasts to provide greater compression when the zipper is in the front. The bra may be reversed so that a greater area of stretch fabric is position to apply compression against the breast and thereby proved for lessened compression against the breast when the zipper is position in the back of the user.

19 Claims, 6 Drawing Sheets

(56) References Cited

U.S. PATENT DOCUMENTS

| | | | | |
|---|---|---|---|---|
| 6,755,717 | B2 * | 6/2004 | Smith | 450/1 |
| 7,144,294 | B2 * | 12/2006 | Bell et al. | 450/20 |
| 7,381,113 | B2 * | 6/2008 | Hori | 450/55 |
| 7,435,155 | B2 * | 10/2008 | Reinisch et al. | 450/59 |
| 7,442,110 | B2 | 10/2008 | Gaudet et al. | |
| 7,731,564 | B2 * | 6/2010 | Sanders | 450/54 |
| 7,758,401 | B2 * | 7/2010 | Kelley et al. | 450/92 |
| 7,909,675 | B1 * | 3/2011 | Rainey | 450/59 |
| 8,075,368 | B2 * | 12/2011 | Puyaubreau | 450/65 |
| 8,172,639 | B2 * | 5/2012 | Swendseid | 450/85 |
| 8,182,310 | B2 * | 5/2012 | Clair et al. | 450/30 |
| 8,221,186 | B2 * | 7/2012 | Policaro et al. | 450/1 |
| 8,465,341 | B2 * | 6/2013 | Shashy | 450/39 |
| 8,777,693 | B2 * | 7/2014 | Shashy | 450/66 |
| 2001/0019933 | A1 * | 9/2001 | Wagner | 450/37 |
| 2004/0259469 | A1 * | 12/2004 | Cano | 450/86 |
| 2005/0255789 | A1 * | 11/2005 | Gaudet et al. | 450/41 |
| 2008/0287036 | A1 | 11/2008 | McGuire | |
| 2009/0270013 | A1 | 10/2009 | Clair et al. | |
| 2010/0005569 | A1 * | 1/2010 | Sanders | 2/400 |
| 2010/0105284 | A1 | 4/2010 | Policaro et al. | |

* cited by examiner

REVERSIBLE COMPRESSION SUPPORT BRA

CROSS-REFERENCE TO RELATED APPLICATIONS

This Application is a Continuation-in-Part of U.S. application Ser. No. 13/089,691 filed Apr. 19, 2011, which is a Continuation-in-Part of U.S. application Ser. No. 12/773,610, filed May 4, 2010, now issued U.S. Pat. No. 8,645,341, the disclosure of each of which is hereby incorporated herein by reference in its entirety.

TECHNICAL FIELD

The present invention generally relates to women's apparel. More specifically, the present invention is drawn to a reversible bra for providing a first level of compression support to stabilize the breast mass relative to the torso when the bra is worn in a first position and a second different level of compression force when the bra is worn in the reverse position.

BACKGROUND

The breast area has a mobile center of gravity that is offset relative to the upper torso as a whole. The breast may be regarded as a weighted appendage that the body compensates for by adjusting posture and movement to prevent injury. During physical activity, trauma ("injury") to the breast, such as strained tissue or muscle, may occur during abrupt vertical and horizontal motion, such as during jumping or running. The trauma may be temporary (e.g., soreness), or chronic (e.g., permanent damage to breast tissue). Even when a user is not engaged in activity, gravity is capable of causing strain damage, especially if the breasts are large.

Therefore, a bra adapted to provide breast stabilization support, whether during physical activity, or due solely to the effects of gravity, is beneficial.

Implants may lead to greater risk of trauma during physical activity. Implants (in particular silicone implants) may be denser than natural breast tissue and therefore heavier, which can place strain on the skin and breast matter surrounding the implant. Implants are also foreign objects having some mobility, placed either above or underneath the pectoral muscle. Because implants commonly have a structural resiliency greater than human breast tissue, implants can cause a faster breakdown in surrounding breast tissue (e.g., muscles, skin, fat, ligaments, tendons). Therefore, supporting and stabilizing the implants and surrounding tissue against the strain of motion relative to the torso is beneficial.

U.S. Pat. No. 8,465,341 and U.S. patent application Ser. No. 13/089,691 illustrate bras that address this problem of stabilizing breast mass from the point of view of weight management in relation to the torso. The bras effective support the breast area by compression with the torso to make them effectively a single structural entity, thereby eliminating or reducing breast mobility relative to the torso that can result in discomfort and/or trauma. However, the compression force in these bras cannot be reduced or increased without changing to a bra of a different size or design or by the use of an adjustable feature such as hook and eye or hook and loop fasteners. However such fasteners can be cumbersome, can misalign other parts of the bra or cause undesirable tension on other areas of the torso. Therefore there is an additional need to provide a single bra that can apply one compression force when the bra is worn with the closure zipper in front and a second different compression force when the bra is reversed and worn with the closure zipper in back.

SUMMARY

Disclosed is a bra, worn to provide stabilizing support during physical activity, such as while engaging in sports by addressing the breast mass from the point of view of weight management in relation to the torso. The disclosed bra effectively supports the breast area by compression with the torso to make them effectively a single structural entity, where the bra is reversible and can be worn either with the closure zipper in front or the closure zipper is in back. One advantage of this reversibility is that a first compression force is applied when the bra is worn with a closure zipper in front and a second different compression force is applied when bra is reversed and the closure zipper is in the user's back.

The bra is made using a first material layer selected to provide strength for firm, uniform stabilizing support during physical exertion while allowing localized expansion or deformation to conform to localized body shape variations. When worn, the stretchable nature of the fabric exerts an inwardly and downwardly directed compressive force around the circumference of the user's torso while at the same time allowing for localized deformations to conform to localized body shape variations. Suitable fabrics for the first material layer include cellular foam fabrics, closed cell foam, and stretchable Lycra®, spandex type fabrics or combinations of such fabrics. Such fabrics or a combination of them, allow for localized, resilient deformation of the fabric in response to localized body features and body movement while at the same time maintaining uniform inward pressing support for the breast tissue. Some of these fabrics are not currently used in bras for support, stability or weight induced motion management. By manufacturing the material to control, for example, foam cell size (when foam material is used), elastic stiffness, contouring and thickness, a combination of structural support, stiffness, and elasticity may be obtained that provides for comfort, support and reduced motion induced trauma. Additionally, when a closed cell waterproof foam is used for the first material layer, perforations may added to enable body moisture to escape from the skin to the layer outer surface, and also providing air breathability to the skin.

An example of closed cell foam material is neoprene. Closed cell neoprene fabric is waterproof and has found application in aquatic body wetsuits. Similar to the wetsuit, the disclosed stabilizing bra provides consistent contouring compression. When properly fitted initially, the neoprene foam fabric of the stabilizing bra conforms to the individual's shape, resulting in a customized fit. Because neoprene foam is a closed cell, fast recovery foam, it has a long lifetime against break down or loss of elasticity from wear and pressure.

In an embodiment, the bra extends around the upper torso with shoulder straps extending from one side and ending along an upper connection region affixed to the top of the other side of the bra along a seam. The other side also has a vertical, centrally positioned zipper extending from the seam to a bottom of the bra. This not only results in a stabilizing hugging structure of the breast area, but eliminates disproportionate pressure on the shoulders, back, shoulder blades, and area under the bust. Otherwise, poorly or unsupported breast tissue (especially in large breasts) is often found to be the cause of back and shoulder strain, which can be aggravated by physical activity. By distributing the forces generated by breast motion during physical activity over the upper torso area, breast motion is better synchronized with torso motion, and the stress per unit of torso body surface area is reduced. The bra is preferably made from a single fabric cut and then joined along the seam. However, the bra may also be made from separate panels where each panel is designed with different resiliently deformable characteristic around the torso region.

A zipper closure system for closing the bra includes a vertical zipper and slide extending from the seam to the bottom of the bra in the center of the other side of the bra. In an open position, donning the bra is made easier. The zipper preferentially closes from top to bottom, thereby completing the downward compression and stabilization of the breasts with respect to the torso upon closure. An extension affixed to the zipper slide enables convenient reach to open and close the zipper for ease of donning and removing the bra.

A further aspect of the bra is that it is reversible so that the zipper side may be worn either in the front or be reversed and worn in the back and in so doing provide the wearer with two different types and forces of compression with a single garment. In order for the bra to be reversible, both the side without the zipper and the side with the zipper must have hammock regions, that is, a region immediately adjacent the breast that applies inward compression to the breast when the bra is worn. Thus, when the bra is worn with the zipper in the front position, compression on the breast tissue is increased (feels tighter) due to the non-stretching nature of the zipper track located between the breasts. Because zippers do not stretch vertically or horizontally, there is less stretch fabric between the zipper track and the side if the bra which results in less stretch and hence greater compression force against the breast tissue. In addition, the horizontal seam above the zipper adds a greater downward urging to the breast tissue since the threads on that seam restrict further restrict the area over which the fabric stretch can occur. When the bra is worn with the zipper in front, the hammock region, the region adjacent to an pressing against the breast, will be on either side of the zipper below the seam at the bust line and above the elastic under band located around the circumference of the bra.

When the bra is reversed and the zipper positioned in the back, the compression force is spread across the entire front width of the bra allowing a greater area of stretchable fabric across the breast tissue and hence more stretching resulting in less compression on the breast tissue adjacent the hammock region.

An elastic under band position at the lowermost circumference of the bra has an inverted arch shape on the non-zipper side which allows additional hammock area for the breast tissue when there is less compression force. This results in a different type of compression than when the zipper is located in the front—namely the arched band and larger hammock area encourages an increased flattening of the breast tissue (downward and inward) in which the lesser compression is still sufficient to stabilize the breast during vigorous activity.

A user may elect to wear the bra with the zipper in front when greater compression is desired such as during vigorous sustained exercise. Alternatively, a user may elect to wear the bra with the zipper in back for greater comfort in less vigorous exercise or when the beasts are temporarily enlarged.

The fabric area on either the zipper side or non-zipper side both below and above the breasts are extended over the torso surface to provide for compression stabilization of the breast mass center of gravity both closer to the torso and, optionally, compression of the breast mass lower on the torso. The compression acts to stabilize against motion relative to the torso by distribution of compression support over a large body area. This overall compression toward the torso, and larger torso contact area (both back and front), also reduces pressure and stress to the shoulders, back and upper chest that would otherwise occur.

A size determining measurement includes taking the normal bustline measurement so that the circumference of the bra is substantially the same as the circumference of the user as measured around the user's bustline with the breasts circumferentially compressed to a user selected compression.

Accordingly, the invention provides a support bra which is adapted to stabilize breast motion relative to the torso by compression applied around the entire torso during movement.

The invention also provides a support bra which is adapted to stabilize breast motion relative to the torso by inward and downward compression during physical activity.

The invention also provides a bra which does not require any rigid or semi-rigid breast supporting structures, such as, for example, under-wires or cups.

DESCRIPTION OF THE FIGURES

For a more complete understanding of the present disclosure, reference is now made to the following descriptions taken in conjunction with the accompanying drawings.

DETAILED DESCRIPTION

Figure 1:
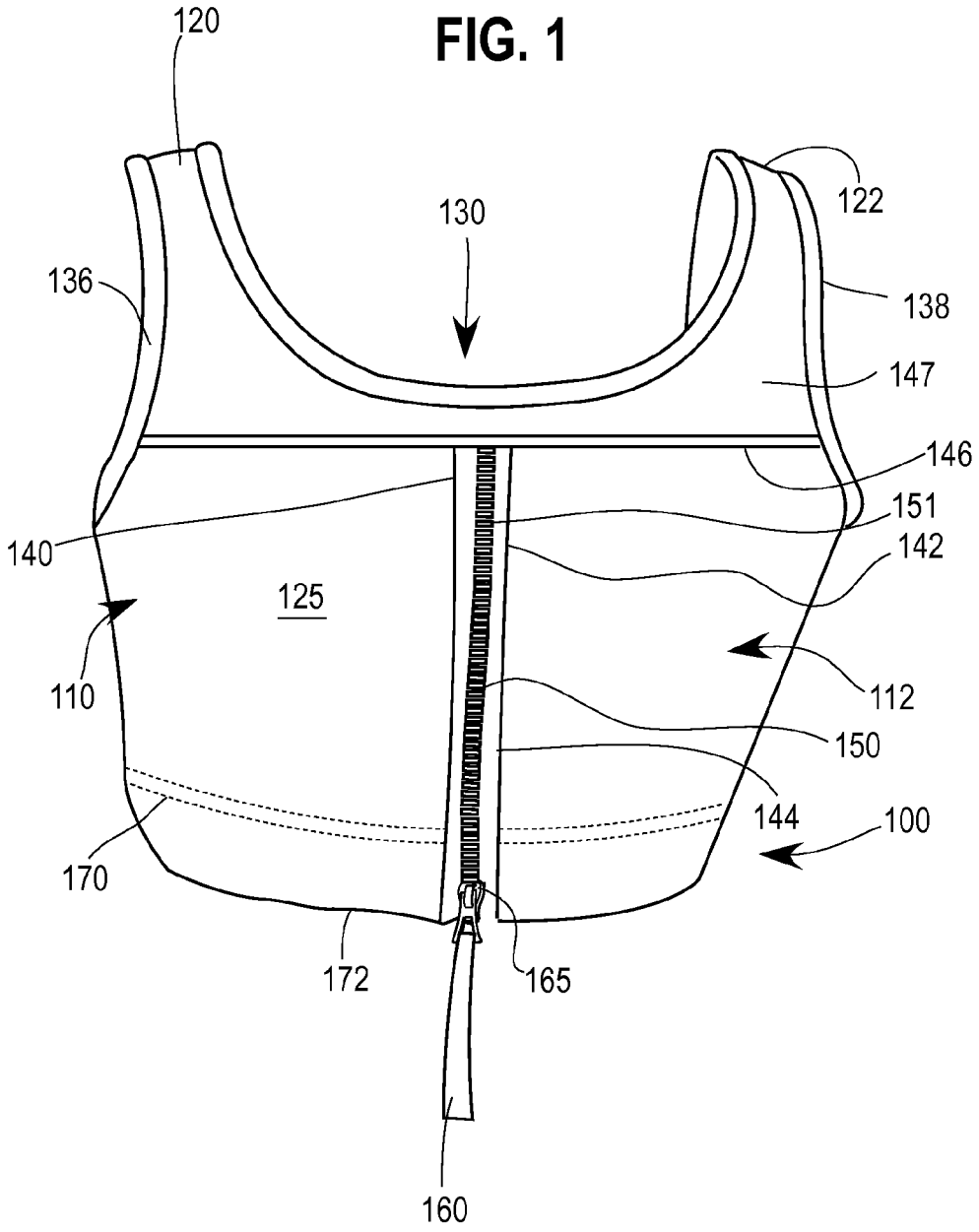
FIG. 1 shows a perspective view of a zipper side of a support bra in accordance with the disclosure.
Figure 2:
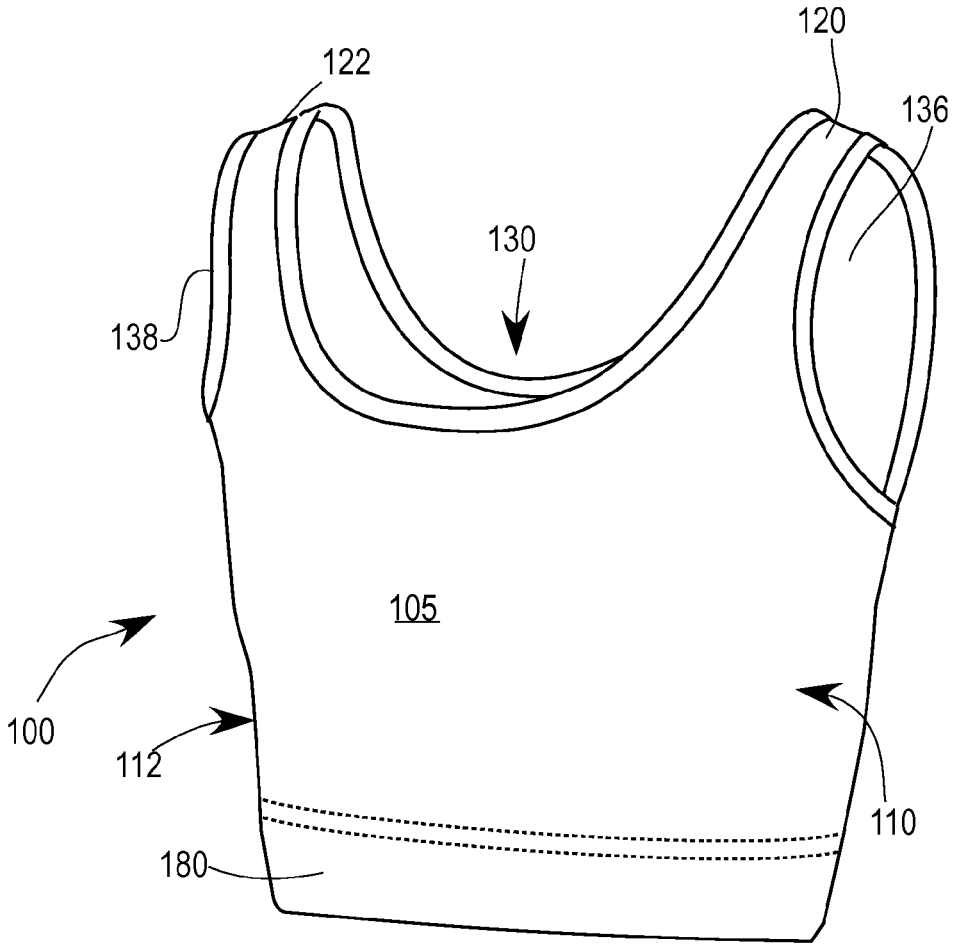
FIG. 2 shows a perspective view of the side of the support bra of FIG. 1 opposite the zipper side.

In an embodiment as shown in FIGS. 1 and 2, a bra 100 to be worn by a user may include a single piece of fabric cut to provide a non-zipper side 105, sides 110 and 112 shoulder straps 120 and 122, and a zipper side 125. A neck opening 130 is provided between the shoulder straps 120 and 122 to enable placement of the bra 100 over the user's head with the shoulder straps resting on the shoulders of the user and the arms of the user extending through arm hole 136 on the side 110 and arm hold 138 on side 112 for insertion of the arms there through. The fabric between the neck opening 130 and each of the arm holes 136 and 138 define the shoulder straps 120 and 122 respectively that overlay the user's shoulders.

The bra 100 may be donned by pulling over the user's head through the neck opening 130 and inserting the user's arms through the arm holes 136 and 138. Alternatively, for users who find it difficult to raise the arms to put on the bra, the embodiment illustrated allows a user to step into the neck opening 130 and pull the bra up into position with the arms moved into position through the arm holes 136 and 138 to position the straps 120 and 122 on the user's shoulders.

A closure system such as a zipper 150 may be included on the zipper side 125 opposite the non-zipper side 105 of the bra 100 as shown in FIGS. 1 and 2. For example, the zipper side 125 has a center opening 144 extending from a horizontal seam 146 which extends between the two arm holes 136 and 138 at a location near but below the neck opening 130 and a bottom edge 172 of the bra 100. The center opening 144 has two edges 140 and 142 each of which are sewn or otherwise fixed to each side of the zipper 150 so that the zipper 150 is attached to each edge 140 and 142 between the top of the center opening 144 at the horizontal seam 146 and the bottom edge 172. The zipper 150 includes a slider 165, attached between the two sides of a zipper track 151 so that the zipper 150 is opened or closed by moving the slider 165 along the zipper track 151 between the horizontal seam 146 and the bottom edge 172. In an embodiment using a zipper 150 or other zipper-like closure mechanism, an extension 160 (e.g., string, strap, or the like) may be added to the slider 165 to make an opening and closing manipulation of the zipper 150 and slider 165 easier for the user particularly when the zipper is located at the user's back. The closure is accomplished by top to bottom motion of the slider 165 along the zipper track.

The bottom edge 172 extends around the circumference of the bra 100. The bra 100 further included a band 170 attached to the bra 100 around the circumference of the bra which defines the bottom edge 172. The bottom edge 172 and the band 170 extend around the user below the user's breasts so as to snugly contact the user's torso immediately below the user's breast. The band 170 is sufficiently wide to provide firm contact to the body over a larger torso area in order to facilitate compressively stabilizing the breasts in relation to the torso. The non-zipper side 105 and the zipper side 125 each have hammock areas above the band 170 to provide space, whether the zipper is positioned in the front or the back, to effect compression of the breasts in a downward direction against the torso.

The fabric may comprise neoprene, or an equivalent fabric with mechanical properties selected to have suitable elastic strength to provide compressive support to breast tissue, at least partially or substantially immobilizing the breasts relative to the torso during physical movement. Thus, the breasts and torso are contained to behave substantially as a single structure during physical motion to reduce strain and possible trauma to breast tissue, including breasts containing implants.

The locally and resiliently deformable fabric used to make the bra may be over-sheathed, sewn, bonded or laminated on an inner surface facing the user's body, exterior surface, or both, with a "breathable" fabric to wick moisture (such as perspiration) during physical activity. The breathable fabric may or may not be elastic, and may or may not further contribute to compression stabilization of the breasts. A function of the over-sheath fabric includes providing skin contact comfort and moisture breathability (wicking). Exemplary inner and outer oversheath material may include nylon, Lycra®, spandex, cotton, blends of these materials, or the like, which have suitable stretch and wicking properties.

All cut edges and seams of the fabric of the bra 100 may be finished for cosmetic appearance and to prevent unraveling and/or fraying at the fabric edges and may be covered between the seams and the user for comfort.

The zipper side 125 and non-zipper side 105 are made sufficiently large so that whether worn with the zipper in the front or the zipper in the back the fabric area will be sufficiently large to apply compression force against the user's breasts.

In an embodiment, the bra may be cut from a single piece of fabric with the bra formed into a wearable garment by attaching the strap region to the top of zipper side 125 along the horizontal seam 146. Alternatively, the bra may be made from a plurality of separate pieces sewn together. In the alternative construction, it will be understood that the amount of compression applied will change based on the location of the seams and whether the seams are non-stretchable or stretchable. Therefore custom configurations with different compression forces can be provided by adding seams at selected locations on the zipper side or the non-zipper side of the bra with the compression also being changeable by wearing the bra with the zipper (with a non-stretchable seam) in the front or in the back. As an example, when the bra is worn with the zipper in front (where the zipper would be a non-stretchable seam), the compression would be greater whereas wearing the bra with the zipper in the back would result in a more relaxed compression in the front.

Figure 3:
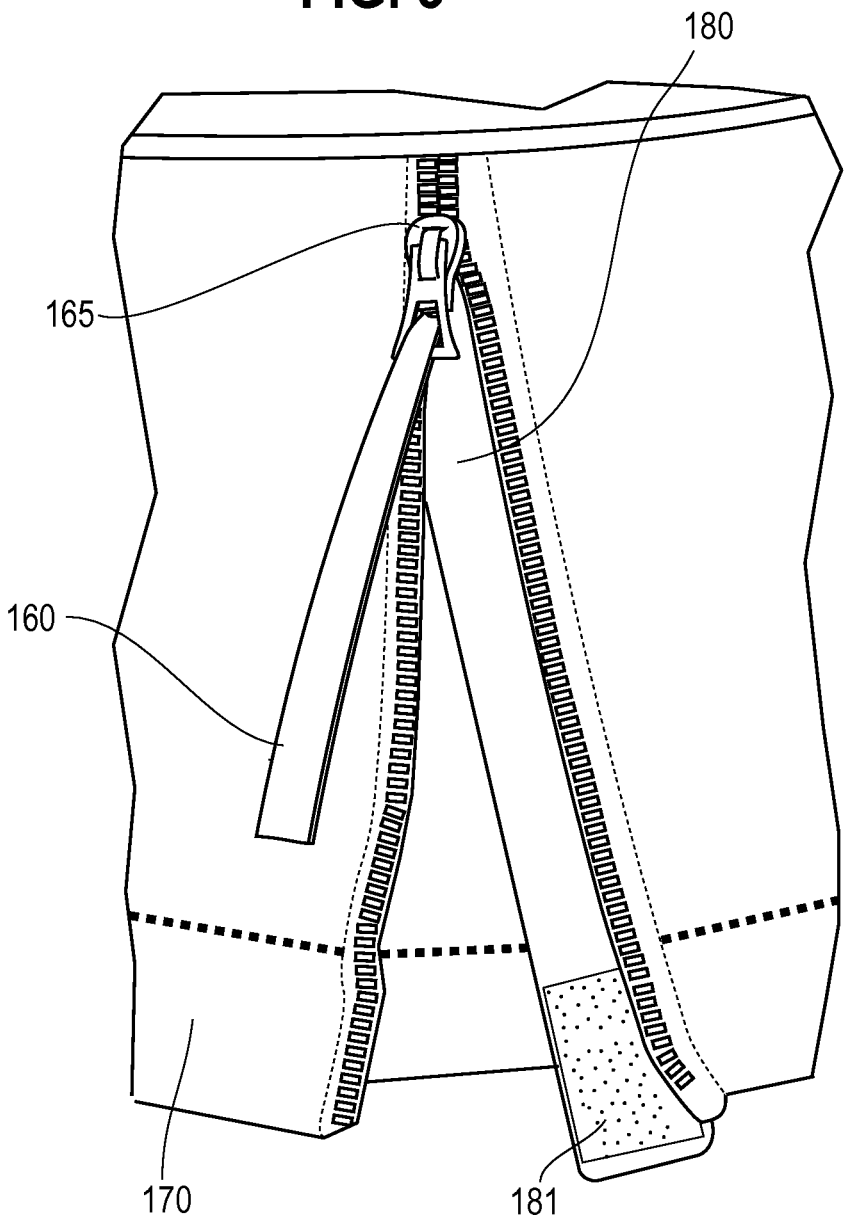
FIG. 3 shows a detail of zipper guard flap positioned between the zipper and the user.

Referring to FIG. 3, A fabric flap 180, is positioned on the inside of the bra adjacent the zipper 150 to cover the zipper between the user's body and the zipper so the zipper 150 is not in direct contact with the user and thereby provide greater user comfort. Additionally, the bottom of the flap 180 along the band 170 may include an area of increased thickness such as foam area 181 adjacent the region where the slider 165 will be positioned when the zipper is closed to provide additional cushioning between the slider and the user's body. This is important to protect the user in the event something hard presses the slider against the users. An example would when the user is exercising on the floor and the floor presses the slider against the user's spine. Providing the additional cushioning increases the comfort for the user.

Figure 4A:
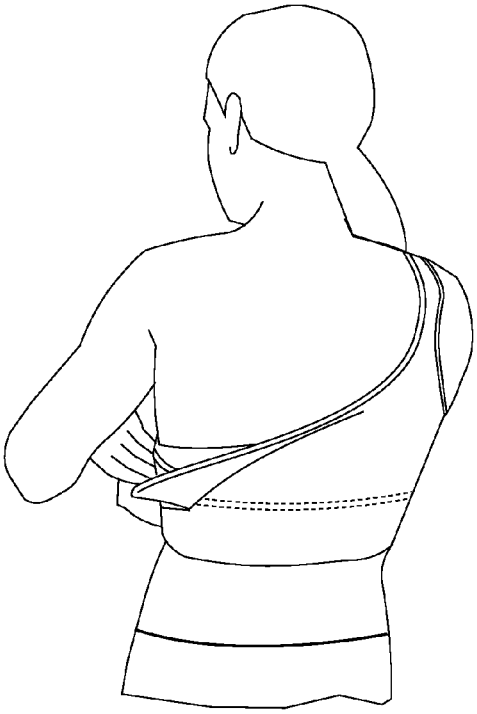
FIGS. 4*a*-4*f* is a sequence of Figures showing how a user puts the bra on and how the bra can be worn with the zipper either in front or in back of the user.
Figure 4B:
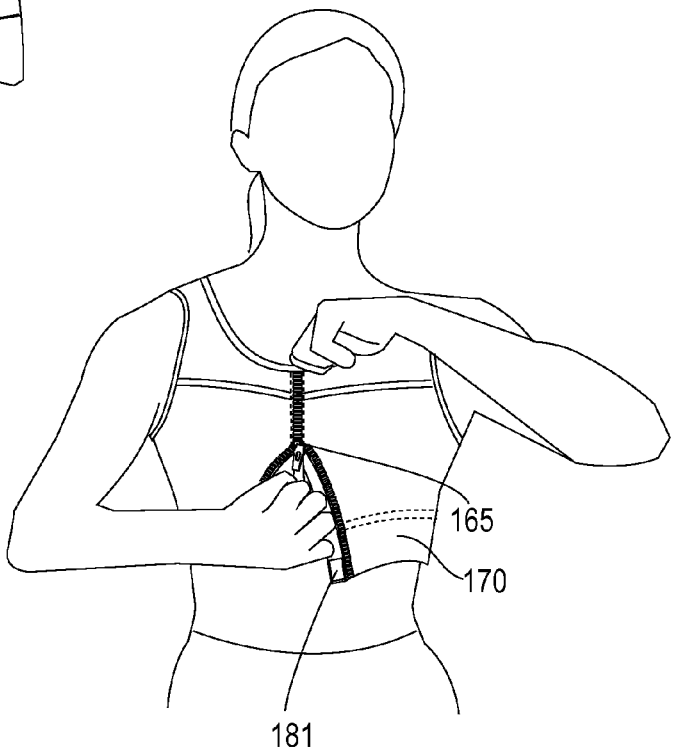
Figure 4C:
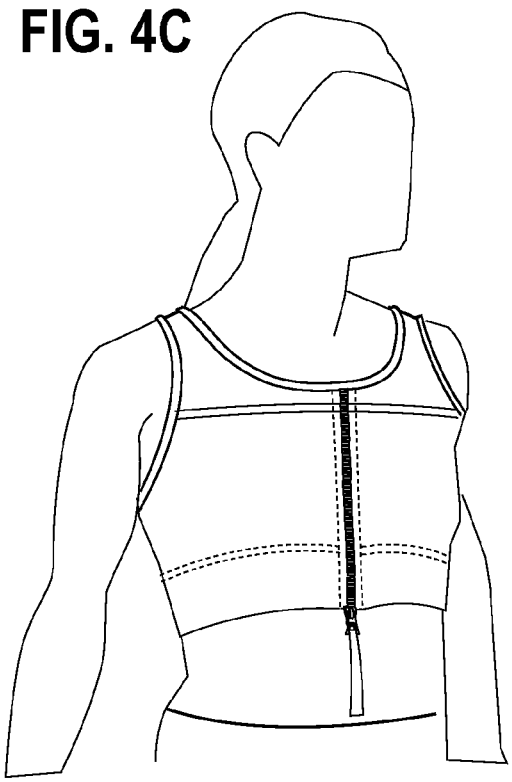
Figure 4D:
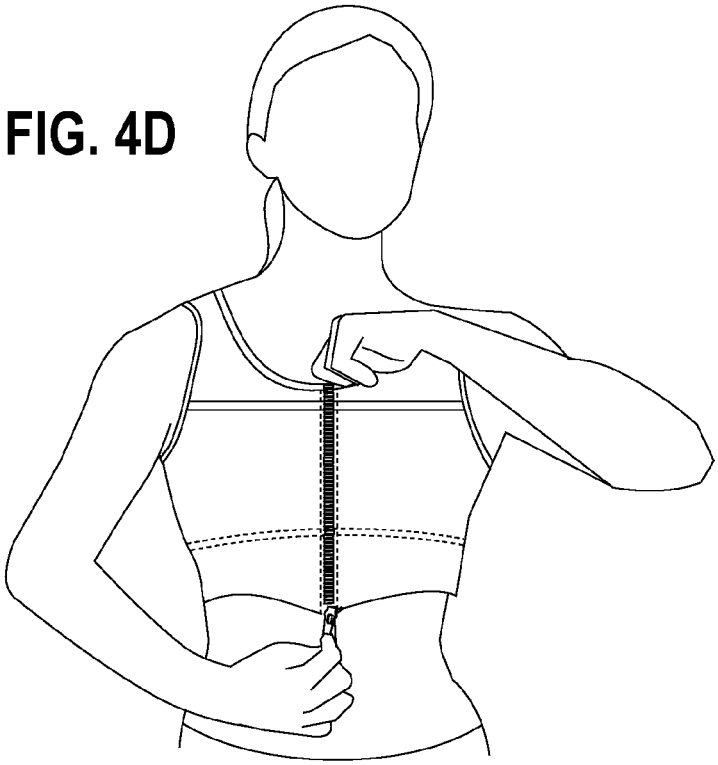
Figure 4E:
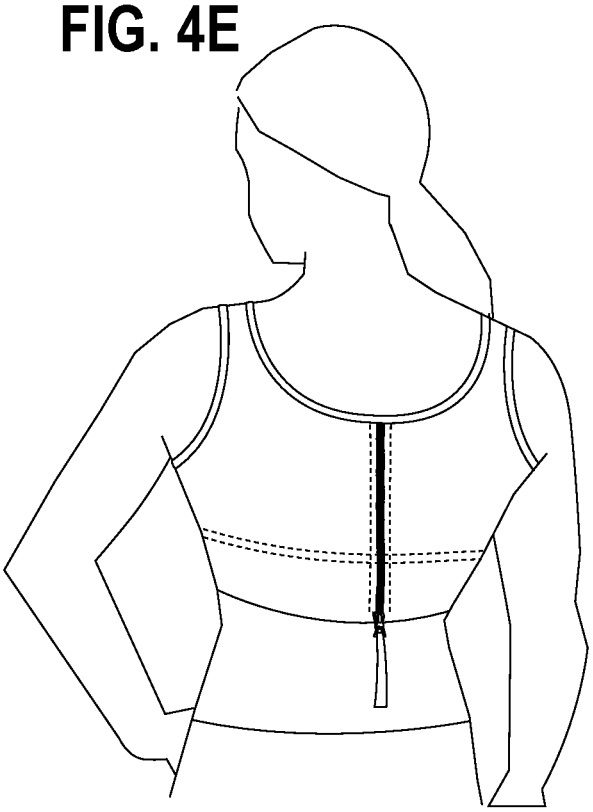
Figure 4F:
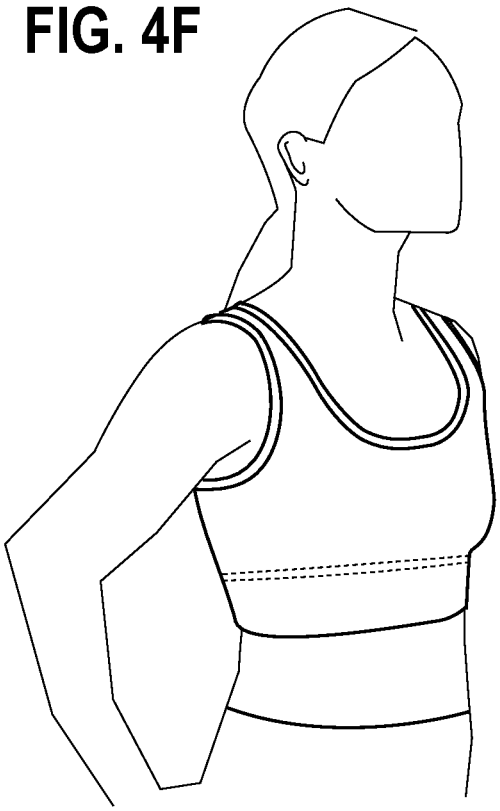

FIGS. 4*a* through 4*f* illustrate the use of the bra. In FIG. 4*a* a user steps into the bra with the zipper in the open position. The strap comes over the shoulders easily with no need to reach or strain. In FIG. 4*b*, with the zipper 165 in front, the user grasps the top of the bra at the sternum for optimal closing leverage and the pulls the zipper down to the fully closed position with the slider at the lower band 170. FIG. 4*c* shows the zipper in its fully closed position where the hidden flap is in position between the zipper and the user to provide comfort and prevent rubbing and chafing. FIG. 4*d* shows on the user with the zipper in front. The area applying compression force to the breast (the hammock area) begins at the base of the armpit and extends across the breast to the zipper which is a non-stretchable seam. The bra fabric then stretches evenly over the upper torso with no stretching tension on the shoulder straps. The elastic band is in the position against the lower ribs several inches below the breasts for optimal control, hold and comfort. FIGS. 4*e* and 4*f* show the bra worn reversed with the zipper in the back. This provides less compression in the front and hence provides a bra that as adjustable compression depending on whether the user wears the zipper in the front or in the back.

The bra disclosed may be effectively used as a sports bra. However, it may also be used after any type of breast surgery. For example, a compression bra as disclosed is the optimal method for a faster and more comfortable surgical recovery. Swelling, tenderness, and mobility issues typically require patients to purchase more than one design and/or size of garment to sufficiently address and transition the different stages of recovery. Because the bra is convertible, that is reversible to obtain different compression effects, the bra can address multiple recovery phases. For example, in the early stages of recovery, the bra is worn with the zipper in the front so that compression and stability is provided.

Because of the "step in" design as above described, the user can don and doff the bra easily without needing to raise the arms or reach backwards or assemble a zipper track as in the fully opening "vest style" bra. A vertically reinforced flat lock seam located immediately above the breasts along with the downwardly directional zipper encourages a downward and inward compression. This is especially ideal for implant placement. This provides support to the breasts, connective tissue and corresponding muscles, as well as to implants.

After several weeks of healing, the bra can be reversed with the zipper position in the back so that the compression against the breasts is more relaxed. At this stage of the healing process the user is experiencing a reduction in swelling and no longer requires such a high degree of compression. However, the user's continued recovery will greatly benefit from a therapeutic level of breast compression and support.

It is to be understood that the present disclosure is not limited to the embodiment described above, but encompasses any and all embodiments within the scope of the following claims.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the embodiments of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. For example, materials with elastic and tensile properties superior to lycra may be utilized. Accordingly, the appended claims are intended to include within their scope such processes, machines, manufacture, compositions of matter, means, methods, or steps.

What is claimed is:

1. A reversible compression bra comprising a resiliently deformable layer of fabric having first and second sections, each said section having a top and a bottom and being formed with two shoulder straps defining an enclosed neck opening at the top thereof and an arm hole on the side of each shoulder strap opposite the neck opening, said sections each being sized to define hammock areas for positioning next to the user's breast; a vertical aperture in said first section extending downward from the vicinity of said neck opening to the bottom of said first section; and a zipper device for closing the bra along said vertical aperture; the zipper device positioned along said vertical aperture for closing the aperture from top to bottom; the zipper device having a slider for opening and closing the zipper device, the zipper device creating a non-resilient region along said vertical aperture when the zipper device is in a closed position, the hammock region of said second section being adjacent to the breast when the first section is at the back of the user and the hammock region of the first section being adjacent to the breast of the user when the first section is in the front of the user, the zipper device urging the fabric inwardly and downwardly against the breast of the user as the zipper device is closed downwardly to exert a first compressive force against the breast when the zipper device is on the user's front side and a second compression force against the breast when the zipper is on the user's back side.

2. The bra of claim 1, wherein the fabric layer of one of said sections comprises at least one non-resilient seam in the fabric layer for modifying the compression applied by said one section to the breast of a user at said hammock region.

3. The bra of claim 1, wherein the fabric layer of at least one of said sections further comprises a plurality of fabric segments divided by non-resilient seams arranged in the fabric layer for selecting and/or altering the compression to be applied at the regions of the fabric between the seams.

4. The bra of claim 1, the fabric being selected to have an elasticity to provide compression support to the user's breasts to stabilize them against motion relative to the torso during physical activity.

5. The bra of claim 1 further comprising at least one non-resilient seam arranged in said fabric for altering the compression applied by the section of the fabric containing said non-resilient seam.

6. The bra of claim 1, wherein the shoulder straps are adjustable.

7. The bra of claim 1, wherein the fabric is at least one of nylon, spandex and cotton, and blends of nylon, spandex and cotton.

8. The bra of claim 1, further comprising a fabric flap positioned between the user's body and the zipper device.

9. The bra of claim 8, further comprising a foam pad on the fabric flap adjacent the slider when the zipper is in the closed position.

10. A reversible compression bra comprising: a resiliently deformable layer of fabric forming the bra, the bra having first and second sections and a vertical aperture on said first section, a zipper device attached to the bra for closing and opening the bra along said vertical aperture, and at least one non-resilient seam to alter the compression applied by the fabric to the breast of a user.

11. The bra of claim 10, the fabric being selected to have an elasticity to provide compression support to the user's breasts to stabilize them against motion relative to the torso during physical activity.

12. The bra of claim 10, wherein the fabric is at least one of nylon, spandex and cotton, and blends of nylon, spandex and cotton.

13. A reversible bra with front and back sections each having resiliently deformable fabric forming breast compression and stabilizing hammock regions, said sections being joined to provide neck and arm apertures, one of said front or said back sections having a vertical opening extending downward from the vicinity of said neck aperture, with non-resilient closure means for sealing said vertical opening from top to bottom, said bra being worn with either of said sections against the breasts whereby different compression force is applied against the breasts as determined by which section is positioned against the breasts.

14. The bra of claim 13, wherein the fabric layer in a least one of said sections includes a non-resilient seam modifying the compression applied by the fabric layer to the breast of a user at the hammock region adjacent the breast.

15. The bra of claim 13, wherein the fabric layer further comprises a plurality of fabric segments divided by non-resilient seams arranged in the fabric layer for altering the compression applied by the sections of the fabric containing said seams.

16. The bra of claim 13, the fabric being selected to have resilience to provide compression support to the user's breasts to stabilize them against motion relative to the torso during physical activity.

17. The bra of claim 13, further comprising at least one non-resilient seam arranged at defined locations for altering the compression applied at the sections of the fabric containing said non-resilient seams.

18. The bra of claim 13, wherein the fabric is at least one of nylon, spandex and cotton, and blends of nylon, spandex and cotton.

19. The bra of claim 13, further comprising a fabric flap positioned between the user's body and said closure means.

* * * * *